US005469143A

United States Patent [19]

Cooper

[11] Patent Number: 5,469,143

[45] Date of Patent: Nov. 21, 1995

[54] SLEEP AWAKENING DEVICE FOR DRIVERS OF MOTOR VEHICLES

[76] Inventor: David E. Cooper, 1607 E. Libra Dr., Tempe, Ariz. 85283

[21] Appl. No.: 370,637

[22] Filed: Jan. 10, 1995

[51] Int. Cl.[6] ..... G08B 21/00

[52] U.S. Cl. ..... 340/575; 340/576

[58] Field of Search ..... 340/575, 576

[56] References Cited

U.S. PATENT DOCUMENTS

| | | | |
|---|---|---|---|
| 2,210,330 | 8/1940 | Sequin et al. | 340/575 |
| 3,524,030 | 8/1970 | Wiegel | 340/575 |
| 4,463,347 | 7/1984 | Seko et al. | 340/576 |

*Primary Examiner*—Glen Swann
*Attorney, Agent, or Firm*—William E. Hein

[57] ABSTRACT

A sleep awakening device awakens drivers of motor vehicles who are falling asleep while driving. The sleep awakening device includes a pair of eyeglasses and a control unit electrically connected thereto to provide both visual and audible warnings to alert a driver who is falling asleep. The pair of eyeglasses include a sensing lever that is in constant contact with one of the driver's upper eyelid muscles. Downward motion of the eyelid moves the sensing lever downward and actuates a microswitch that is coupled to the sensing lever. The microswitch in turn actuates circuitry located in the control unit to turn on a light each time the driver closes his eyelid. The circuitry includes a time delay relay that initiates an audible signal if the eyelid remains closed for a preset period of time. A normal blink of a driver's eye does not produce an audible alarm. However, if the driver's eyelid fails to open in a predetermined time, the audible alarm will sound. As soon as the driver's eyelid opens, a yellow caution light and the audible alarm are reset. Normal eye blinks produce illumination of the yellow caution light in view of the driver, thereby assuring the driver that the sleep awakening device is functioning properly.

3 Claims, 2 Drawing Sheets

SLEEP AWAKENING DEVICE FOR DRIVERS OF MOTOR VEHICLES

BACKGROUND AND SUMMARY OF THE INVENTION

This invention relates generally to safe driving and more particularly to a device that awakens the driver of a motor vehicle who is falling asleep while driving.

It is believed that many motor vehicle accidents are the result of a driver falling asleep at the wheel, either due to simple drowsiness or to alcohol.

It is therefore the principal object of the present invention to provide a simple yet reliable device for awakening drivers of motor vehicles who are falling asleep while driving.

This object is accomplished in accordance with the illustrated preferred embodiment of the present invention by providing a pair of eyeglasses and a control unit connected thereto to provide both visual and audible warnings to alert a driver who is falling asleep. The pair of eyeglasses include a sensing lever that is in constant contact with one of the driver's upper eyelid muscles. Downward motion of the eyelid moves the sensing lever downward and causes actuation of a microswitch that is coupled to the sensing lever. The microswitch in turn actuates circuitry located in a control unit to turn on a light each time the driver closes his eyelid. The circuitry includes a time delay that initiates an audible signal if the eyelid remains closed for a predetermined period of time.

DETAILED DESCRIPTION OF THE PREFERRED EMBODIMENT

Figure 1:
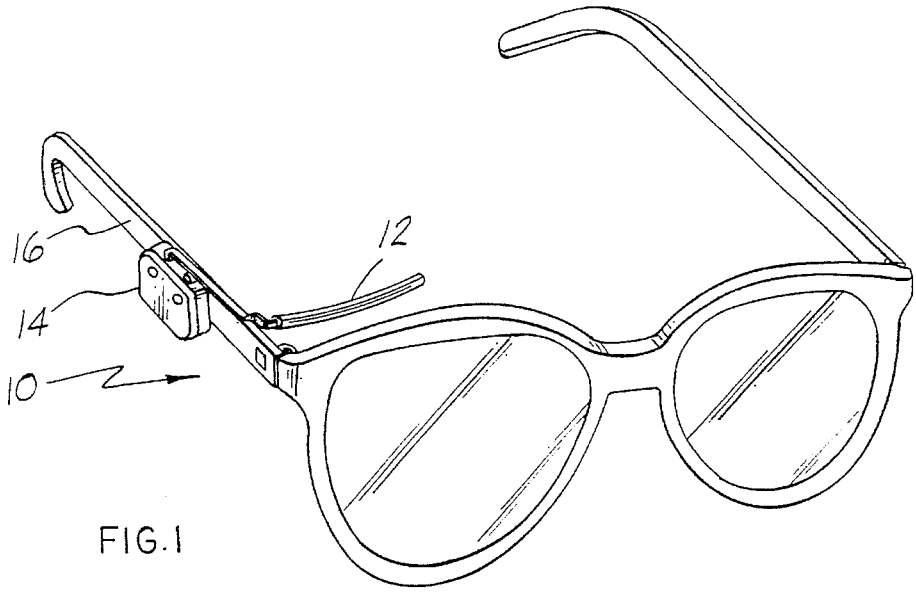
FIG. 1 is a pictorial diagram of a pair of eyeglasses on which is mounted a microswitch employed in the sleep awakening device of the present invention.
Figure 2:
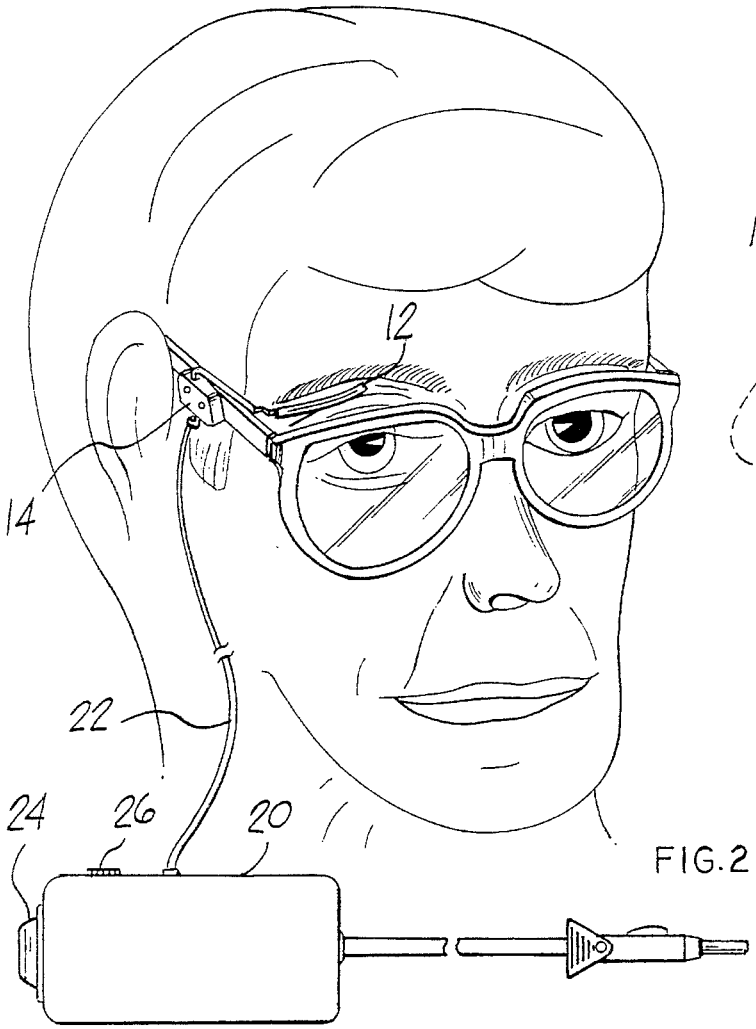
FIG. 2 is a pictorial diagram illustrating the way in which the pair of eyeglasses of FIG. 1 are worn by a driver and also illustrating the control unit that is employed in the sleep awakening device of the present invention.
Figure 3:
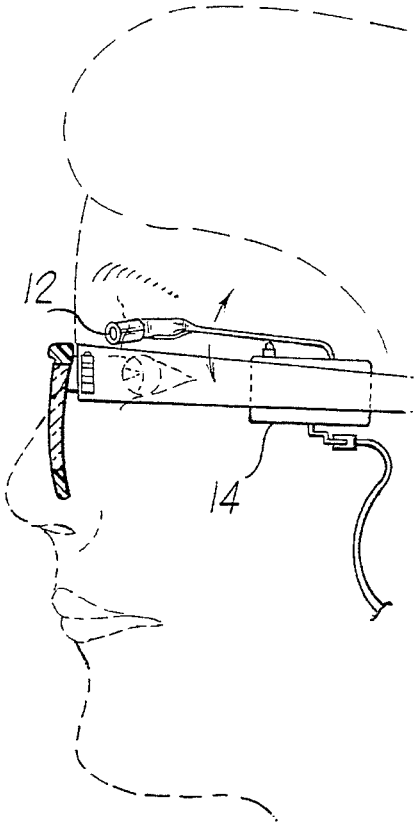
FIG. 3 is a detailed pictorial diagram illustrating the positioning against the driver's upper eyelid muscle of a sensing lever mounted on the pair of eyeglasses of FIGS. 1 and 2.
Figure 4:
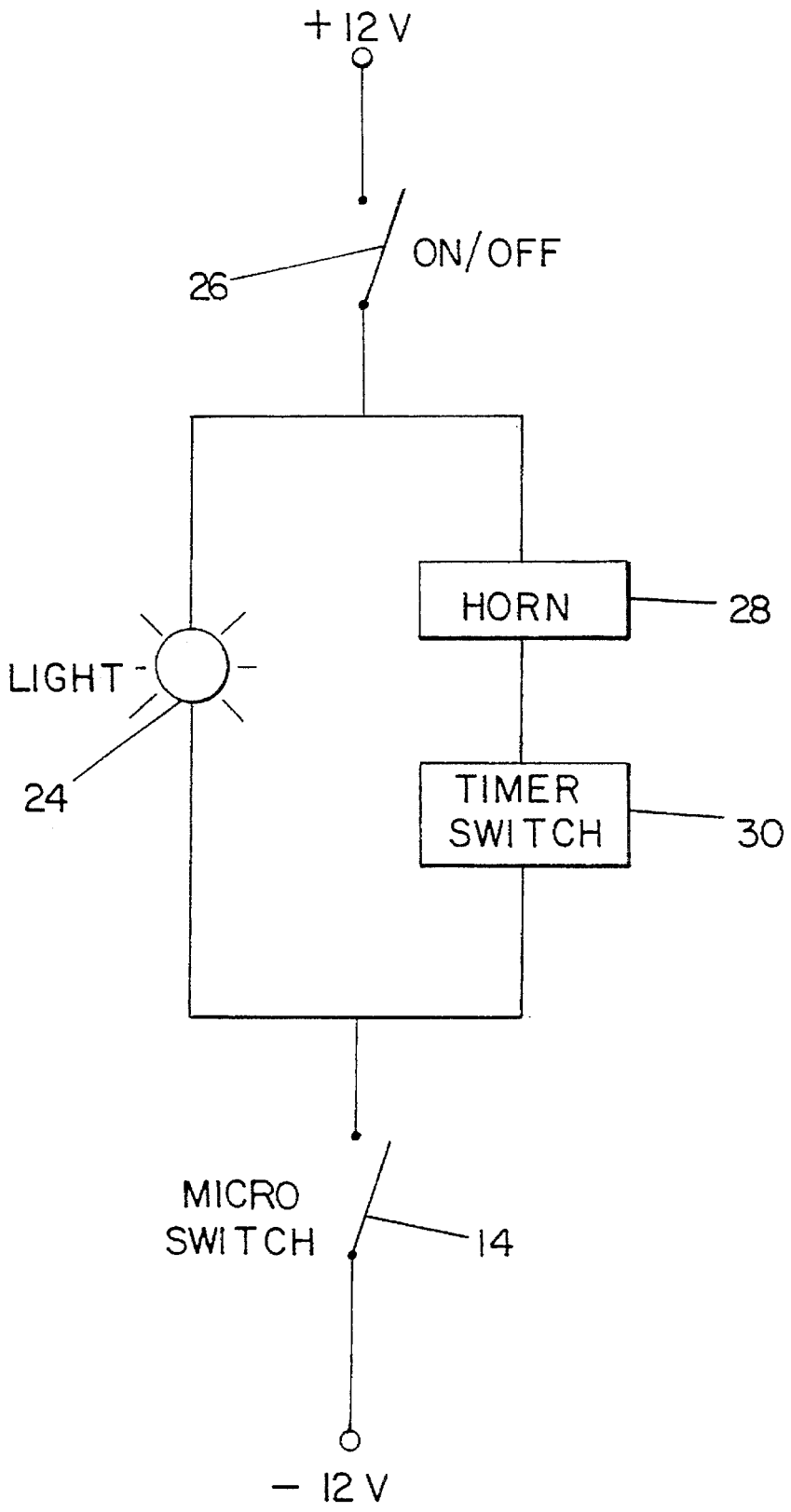
FIG. 4 is a detailed diagram of circuitry employed in the sleep awakening device of the present invention.

Referring now to FIG. 1, there is shown a pair of eyeglasses 10 to be worn by the driver of a motor vehicle. In the event the driver normally wears corrective eyeglasses, the pair of eyeglasses 10 may be fitted with the driver's corrective lens prescription. Otherwise, the pair of eyeglasses 10 may simply contain clear lenses. The pair of eyeglasses 10 includes a conventional microswitch 14 attached to one of the temple members 16. A forwardly and inwardly directed sensing lever 12 is coupled to microswitch 14. When the pair of eyeglasses 10 are worn by the driver, as illustrated in FIGS. 2 and 3, an inwardly directed portion of sensing lever 12 having a slight curvature rests against the driver's upper eyelid muscle. When the eyelid closes downwardly, it moves sensing lever 12 downwardly, as illustrated in FIG. 3, to actuate microswitch 14.

Microswitch 14 is electrically connected to a control unit 20 via a signal cord 22. Control unit 20 may be powered by connection to the vehicle cigarette lighter and may be conveniently positioned in view of the driver. Control unit 20 includes an externally mounted visual sleep indicator 24 that may comprise a yellow lamp, for example. Mounted within control unit 20 are a power switch 26, a conventional piezo horn 28, and a conventional time relay 30 having an adjustable time delay of 0.1 to 10 seconds. Time relay 30 is preferably adjusted by the driver to provide a 2½ to 3 second time delay.

During use of the sleep awakening device of the present invention, the sleep indicator 24 provides a visual indication to the driver each time the driver blinks his or her eye. If the eye remains closed for the period of time to which timer 30 is adjusted, piezo horn 28 sounds to audibly alert the driver untile the eyelid opens again.

Two eyelid muscles are utilized to move sensing lever 12 that touches the driver's upper eyelid to actuate microswitch 14. The obicularis closes the eye and levator opens the eye. Both of these muscles have ample strength, just below the bone located below the eyebrow, to move the sensing lever 12 that is positioned in the recess just below the eyebrow bone. The skin is soft at that point and moves the sensing lever 12 very easily at the slightest movement of the eyelid, merely by the sensing lever 12 lying on the soft skin with a very light touch.

I claim:

1. A sleep awakening device for awakening drivers of motor vehicles who are falling asleep while driving, the sleep awakening device comprising:

a pair of eyeglasses to be worn by the driver, the pair of eyeglasses including a microswitch mounted on a temple member thereof and a sensing lever extending forwardly and inwardly from said microswitch, the sensing lever being positioned to be in constant contact with an upper eyelid muscle of the driver and to move downwardly and upwardly in concert with said upper eyelid muscle as it closes and opens, respectively; and a control unit electrically connected to said microswitch, the control unit including light means for providing a visual indication each time the driver's upper eyelid closes, the control unit further including adjustable time delay means and horn means for providing an audible signal when the driver's upper eyelid muscle has remained closed for a predetermined period of time to which said time delay means has been adjusted.

2. A method for awakening drivers of motor vehicles who are falling asleep while driving, the method comprising the steps of:

providing a pair of eyeglasses to be worn by the driver, the pair of eyeglasses including a microswitch mounted on a temple member thereof and a sensing lever extending forwardly and inwardly from said microswitch, the sensing lever being positioned to be in constant contact with an upper eyelid muscle of the driver and to move downwardly and upwardly in concert with said upper eyelid muscle as it closes and opens, respectively;

detecting downward movement of said upper eyelid muscle;

providing a visual indication each time the driver's upper eyelid closes; and providing an audible indication when the driver's upper eyelid has remained closed for a predetermined period of time.

3. A method for awakening drivers of motor vehicles who are falling asleep while driving, the method comprising the steps of:

detecting downward movement of an upper eyelid muscle of a driver;

providing a visual indication each time the driver's upper eyelid closes; and providing an audible indication when the driver's upper eyelid has remained closed for a predetermined period of time.

* * * * *